US008141562B2

(12) United States Patent
Prague

(10) Patent No.: US 8,141,562 B2
(45) Date of Patent: Mar. 27, 2012

(54) COSMETIC CONTAINER SYSTEM INCLUDING TAB-HINGED COVER

(75) Inventor: David Prague, Ringoes, NJ (US)

(73) Assignee: L'Orèal S.A., Paris (FR)

( * ) Notice: Subject to any disclaimer, the term of this patent is extended or adjusted under 35 U.S.C. 154(b) by 470 days.

(21) Appl. No.: 11/296,253

(22) Filed: Dec. 8, 2005

(65) Prior Publication Data

US 2007/0131240 A1 Jun. 14, 2007

(51) Int. Cl.
*A45D 42/02* (2006.01)

(52) U.S. Cl. ..... 132/301; 132/293

(58) Field of Classification Search ..... 132/91, 132/293–296, 300, 301, 314–316; 206/581, 206/523; 220/4.26, 4.27
See application file for complete search history.

(56) References Cited

U.S. PATENT DOCUMENTS

| | | | |
|---|---|---|---|
| 1,463,259 | A | 7/1923 | Flagg |
| 1,688,042 | A | 10/1928 | Gaess |
| 2,327,513 | A | 8/1943 | Esterow |
| 3,152,716 | A | 10/1964 | Feldhahn |
| 3,188,157 | A | 6/1965 | Rand |
| 3,264,678 | A | 8/1966 | Parmelee |
| 3,277,681 | A | 10/1966 | Bey |
| 3,372,443 | A | 3/1968 | Daddona, Jr. |
| 3,392,868 | A | 7/1968 | Pfrommer |
| 3,441,033 | A | 4/1969 | Flax |
| 3,476,123 | A | 11/1969 | Flax |
| 3,498,471 | A | 3/1970 | Dirkx |
| 3,907,410 | A | 9/1975 | Richmond et al. |
| 3,961,721 | A | 6/1976 | Gordon et al. |
| 4,239,308 | A | 12/1980 | Bradley |
| 4,343,397 | A | 8/1982 | Nozawa et al. |
| 4,384,375 | A | 5/1983 | Gerome |
| 4,513,974 | A | 4/1985 | Lin |
| 4,560,078 | A | 12/1985 | Dubuisson |
| 4,596,329 | A | 6/1986 | Eldridge, Jr. |
| 4,807,773 | A | 2/1989 | Tsai |
| 4,815,483 | A | 3/1989 | DuGrenier et al. |
| 4,858,454 | A | 8/1989 | McAnulty, III |
| 5,005,697 | A | 4/1991 | Jimbo et al. |
| 5,099,659 | A | 3/1992 | Carranza et al. |
| D328,817 | S | 8/1992 | Holland |
| 5,135,012 | A | 8/1992 | Kamen et al. |
| 5,246,020 | A | 9/1993 | Wu |

(Continued)

FOREIGN PATENT DOCUMENTS

EP 0 178 504 A1 4/1985

OTHER PUBLICATIONS

English-language translation of EP 0 178 504 A1.

*Primary Examiner* — Rachel Steitz
(74) *Attorney, Agent, or Firm* — Finnegan, Henderson, Farabow, Garrett & Dunner, L.L.P.

(57) ABSTRACT

A container system for a cosmetic product and/or a cosmetic product applicator may include at least one base including a receptacle having an opening. The receptacle may be configured to contain a cosmetic product and/or an applicator for applying a cosmetic product. The system may also include a device including a cover configured to close the opening, and a tab hingedly associated with the cover. The tab may include a connecting portion configured to removably connect the tab to the base.

34 Claims, 10 Drawing Sheets

U.S. PATENT DOCUMENTS 5,405,004 A 4/1995 Vest et al.
5,534,663 A 7/1996 Rivers et al.
5,632,394 A 5/1997 Mecca et al.
5,657,894 A 8/1997 Bowen
5,704,378 A 1/1998 Machelett
5,740,906 A 4/1998 Lai
5,799,787 A 9/1998 Talbot
5,819,764 A * 10/1998 Sussman ..... 132/293
5,829,622 A 11/1998 Neuman
5,953,771 A 9/1999 VanHuss
6,017,220 A 1/2000 Snelson
6,035,865 A 3/2000 Krieger
6,070,749 A 6/2000 Joulia
6,145,515 A 11/2000 Wu
6,196,232 B1 3/2001 Chkadua
6,223,921 B1 5/2001 Huang
6,245,006 B1 6/2001 Olson
6,264,199 B1 7/2001 Schaedel
6,302,120 B1 10/2001 Kuo
6,321,925 B1 11/2001 Crouse et al.
6,553,626 B2 4/2003 Coburn
2002/0153376 A1 10/2002 Seidler
2002/0162565 A1 * 11/2002 Sebban ..... 132/293
2003/0167599 A1 9/2003 Seidler
2004/0200755 A1 * 10/2004 Gueret ..... 206/581
2004/0244812 A1 * 12/2004 Seidler et al. ..... 132/301
2005/0194384 A1 * 9/2005 Petit ..... 220/230

* cited by examiner

COSMETIC CONTAINER SYSTEM INCLUDING TAB-HINGED COVER

BACKGROUND OF THE INVENTION

1. Field of the Invention

The present invention relates to a container system. In particular, some aspects of the invention relate to a container system for containing one or more cosmetic products and/or cosmetic product applicators.

2. Description of the Related Art

Containers come in a number of different shapes, sizes, and forms. One type of conventional container arrangement generally includes a lid movable with respect to another container portion so as to permit one or more items or substances to be removed from an interior of the container and/or added to the container interior. For a variety of different reasons, it may be desirable to have a container system that contains various cosmetic products and/or cosmetic product applicators and thereby permits selection of those products and/or product applicators based on, for example, color or desired make-up effect. Such a container system may have any number of optional design features. For example, it may be desirable to have a cover having a particular ornamental appearance. It may also be desirable to place a mirror on the cover and to limit movement of the cover with respect to a base so that, for example, users may orient the cover in a particular fashion so as to obtain a better view of themselves in the mirror during application of a cosmetic product.

For these and other reasons, there is a need for alternative approaches.

SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

One aspect of the invention relates to a container system for at least one of a cosmetic product and a cosmetic product applicator. The system may include a base including a receptacle having an opening. The receptacle may be configured to contain at least one of a cosmetic product and an applicator for applying a cosmetic product. The system may further include a device including a cover configured to close the opening, and a tab hingedly associated with the cover. The tab may include a connecting portion configured to removably connect the tab to the base.

In one aspect, the tab may not completely surround the opening in the base.

In a further aspect, the receptacle may contain a cosmetic product. Alternatively, or in addition, the receptacle may contain a cosmetic product applicator.

In still another aspect, the base and the tab may be removably connected to one another via magnetic attraction. For example, at least one of the tab and the base may include at least one magnetic element.

According to still a further aspect, the connecting portion may include a reusable adhesive layer configured to removably connect the tab and the base to one another. According to some aspects, the connecting portion may include at least one of a hook portion and a loop portion of a hook and loop fastener system, and the base may include the other of the hook portion and the loop portion. The hook and loop fastener system may be configured to removably connect the tab and the base to one another.

In yet another aspect, the connecting portion may include one of a protrusion and a recess, and the base may include the other of the protrusion and the recess, such that the connecting portion and the base are configured to align with one another.

In still a further aspect, the cover may include a mirror.

In yet another aspect, the system may include a latching mechanism configured to maintain closure of the cover. For example, the latching mechanism may include a magnetic attraction between the tab and the cover. In some aspects, the latching mechanism may include a latch element provided on the cover, and the latch element may be configured to be attracted to a magnetic element. For example, the latch element of the cover may include a metallic element and the connecting portion may include at least one magnetic element.

According to a further aspect, the tab and cover may be hingedly associated via a hinge-like structure. According to some aspects, the cover may include a catch located opposite the hinge-like structure and the base may include a cooperating catch configured to engage with the catch of the cover. In some aspects, the hinge-like structure may include at least one pin and at least one aperture located on at least one of the tab and the cover. In other aspects, the hinge-like structure may include one of protrusions and recesses provided on the cover and the other of the protrusions and the recesses provided on the tab. In still other aspects, the hinge-like structure may include a flexible member associating the cover with the tab in a hinge-like fashion.

In still another aspect, the cover may be configured to move in a hinge-like manner with respect to the base between a closed position in which the cover covers the opening of the base and an open position in which access to the receptacle is permitted. In some aspects, the device may be configured to limit an extent of the hinge-like movement of the cover so that when the cover is moved from the closed position to the open position, the cover moves with respect to the base up to a maximum angular extent of less than about 180 degrees.

In still a further aspect, the system may include a second base including a receptacle having an opening. In some aspects, the second base may be configured to be removably associated with the base. For example, the base and the second base may each include at least one magnetic element, the magnetic elements coupling the base and the second base to one another. In some examples, the magnetic coupling of the base and the second base may permit movement of the base with respect to the second base, in a generally hinge-like manner, between a closed position in which the base covers the opening of the second base receptacle and an open position in which access to the opening of the second base receptacle is permitted. Additionally (or alternatively), the magnetic elements may permit the base and the second base to be magnetically coupled to one another while the base is stacked on the second base and/or while the second base is stacked on the base. According to some aspects, at least one of the base receptacle and the second base receptacle may contain at least one of a cosmetic product and a cosmetic product applicator.

According to another aspect, a container system for at least one of a cosmetic product and a cosmetic product applicator may include a base including a receptacle having an opening. The receptacle may be configured to contain at least one of a cosmetic product and an applicator for applying a cosmetic product. The system may further include a device including a cover configured to close the opening, and a tab hingedly associated with the cover such that a hinging axis is defined. The tab may include a connecting portion configured to removably connect the tab to the base, and the cover may define a recess such that when the tab is connected to the base and the cover closes the opening, the tab is housed in the recess and is not visible when the container system is viewed in a direction parallel to the hinging axis.

According to still a further aspect, a container system for at least one of a cosmetic product and a cosmetic product applicator may include a base including a receptacle having an opening, and the receptacle may be configured to contain at least one of a cosmetic product and an applicator for applying a cosmetic product. The system may further include a device including a cover configured to close the opening, and a tab hingedly associated with the cover. The tab may include a connecting portion configured to removably connect the tab to the base, and one of the cover and the tab may include a magnetic element and the other of the cover and the tab may include an element attracted to the magnetic element so as to releasably maintain the cover in a closed position.

In still a further aspect, a container system for at least one of a cosmetic product and a cosmetic product applicator may include a first base including a receptacle having an opening and a second base including a receptacle having an opening. Each of the receptacles may be configured to contain at least one of a cosmetic product and a cosmetic product applicator. The system may further include a device including a cover configured to close the opening of at least the first base, and a tab hingedly associated with the cover. The tab may include a connecting portion configured to removably connect the tab to the first base, and the first base may include at least one first magnet and the second base may include at least one second magnet, the first and second magnets coupling the first base and the second base to one another.

Aside from the structural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DESCRIPTION OF A FEW EXEMPLARY EMBODIMENTS

Figure 1:
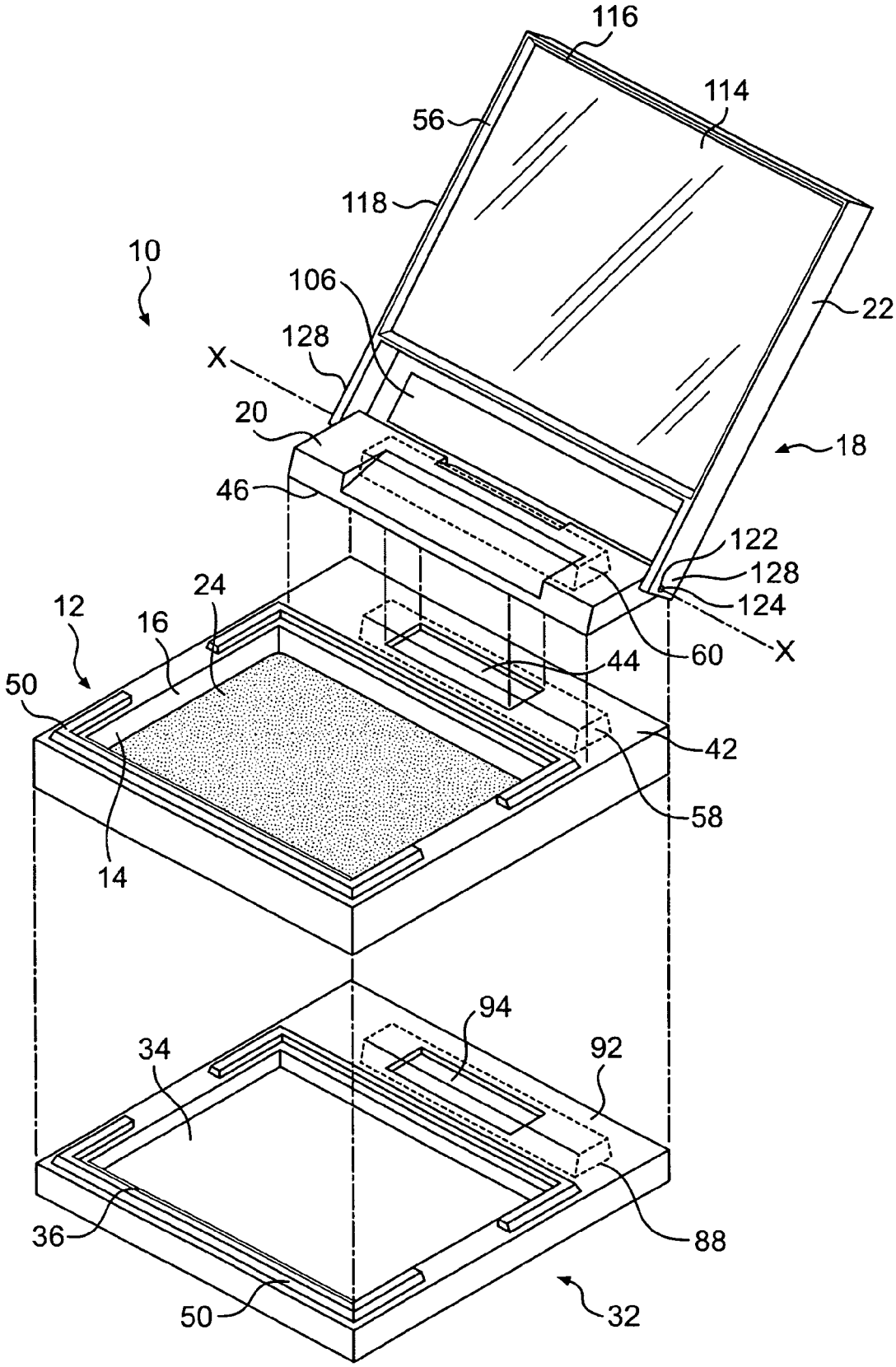
FIG. 1 is a schematic, perspective assembly view of an embodiment of a container system in accordance with the present invention.

Reference will now be made in detail to a few exemplary embodiments of the invention. Wherever possible, the same reference numbers are used in the drawings and the description to refer to the same or like parts.

Figure 2:
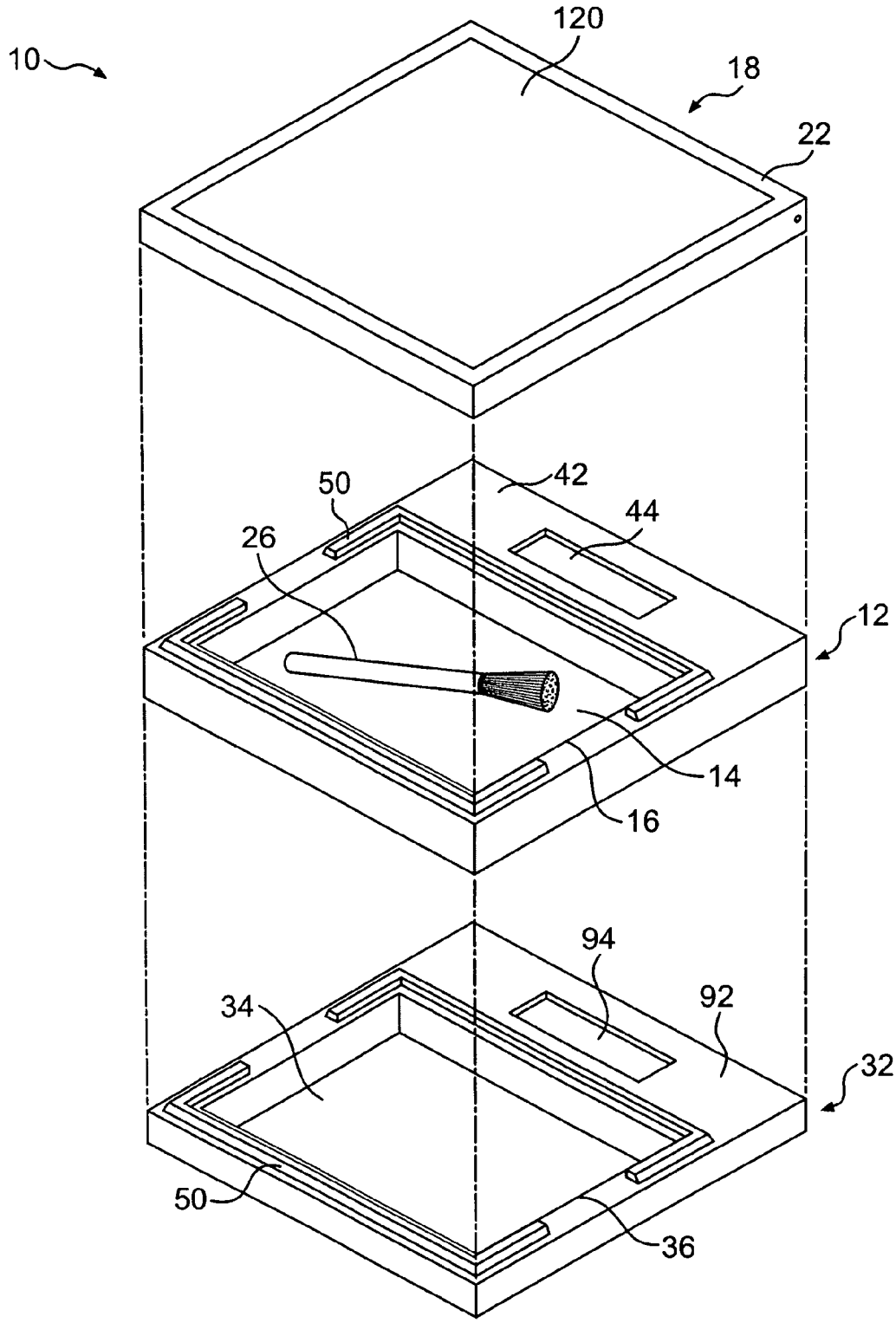
FIG. 2 is a schematic, perspective assembly view of an alternative embodiment similar to that of FIG. 1 and illustrated with a tab being hidden from view by a cover.

FIG. 1 depicts an exemplary embodiment of a container system 10 for a cosmetic product and/or a cosmetic product applicator. The exemplary container system 10 includes a base 12 defining at least one receptacle 14 having an opening 16, and a device 18 including a tab 20 and a cover 22. The receptacle 14 is configured to contain one or more cosmetic products 24 and/or one or more cosmetic product applicators 26 (see, e.g., FIG. 2). Alternatively, a cosmetic product may be contained within an optional pan (not shown) that is attached within the receptacle 14. The cosmetic product could be any form of solid, semi-solid, powder, and/or friable cosmetic product. For example, the cosmetic product could be a cosmetic product intended to be applied to the skin, lips, eyelids, cheeks, finger nails, toe nails, and/or hair (e.g., scalp hair or eyelashes). In some examples, the cosmetic product could be a makeup product (e.g., a makeup product having a coloration) and/or include a fragrance.

The cover 22 is configured to close the opening 16 of the receptacle 14 (see, e.g., FIG. 4), so as to limit access to the receptacle 14 via the opening 16. The tab 20 is hingedly associated with the cover 22 such that the cover 22 may be moved (e.g., pivoted) about an axis X between an open position 28 (see, e.g., FIG. 3), allowing access to the opening 16 of the receptacle 14, and a closed position 30 (see, e.g., FIG. 4) in which the cover 22 closes the opening 16 of the receptacle 14.

As described in more detail below, the tab 20 is removably connected to the base 12. When the tab 20 is removably connected to the base 12, the tab 20 does not completely surround the opening 16 in the base 12. For example, as shown in FIG. 1, the tab 20 extends along only one side of the opening 16 rather than extending around the entire opening 16 and forming an annular or rectangular frame-shaped member. By virtue of the tab 20 not completely surrounding the opening 16, such an arrangement may yield a system having a relatively slim appearance, which may lend itself to taking up less space in, for example, a handbag.

Some embodiments may also include one or more bases, such as, for example, a second base 32 defining one or more receptacles 34 for containing one or more cosmetic products and/or one or more cosmetic product applicators similar to the base 12. Each of the receptacles 34 defines an opening 36 that may be closed by either the device 18 including the tab 20 and the cover 22 (e.g., when the device 18 is connected directly to the second base 32) or another base, such as, for example, the base 12.

By virtue of such an arrangement, a user of the system may connect any number of bases having differing and/or additional products and/or product applicators contained in the receptacles to the device 18. For example, one base may contain a cosmetic product and/or associated cosmetic product applicator that results in a different appearance (e.g., a different color and/or make-up effect) than the appearance of the cosmetic product and/or cosmetic product applicator contained in another base. By substituting one base for another for use with the device 18, a user may be able to create a customized container having one or more particular cosmetic products and/or product applicators for a given situation (e.g., a formal, evening situation). In addition, by virtue of being able to stack any number of additional bases onto the system, a user may be able to access in one system a number of differing cosmetic products and/or cosmetic product applicators, so that the user is able to obtain differing appearances for different situations without the need to carry more than one cosmetic compact.

Figure 5:
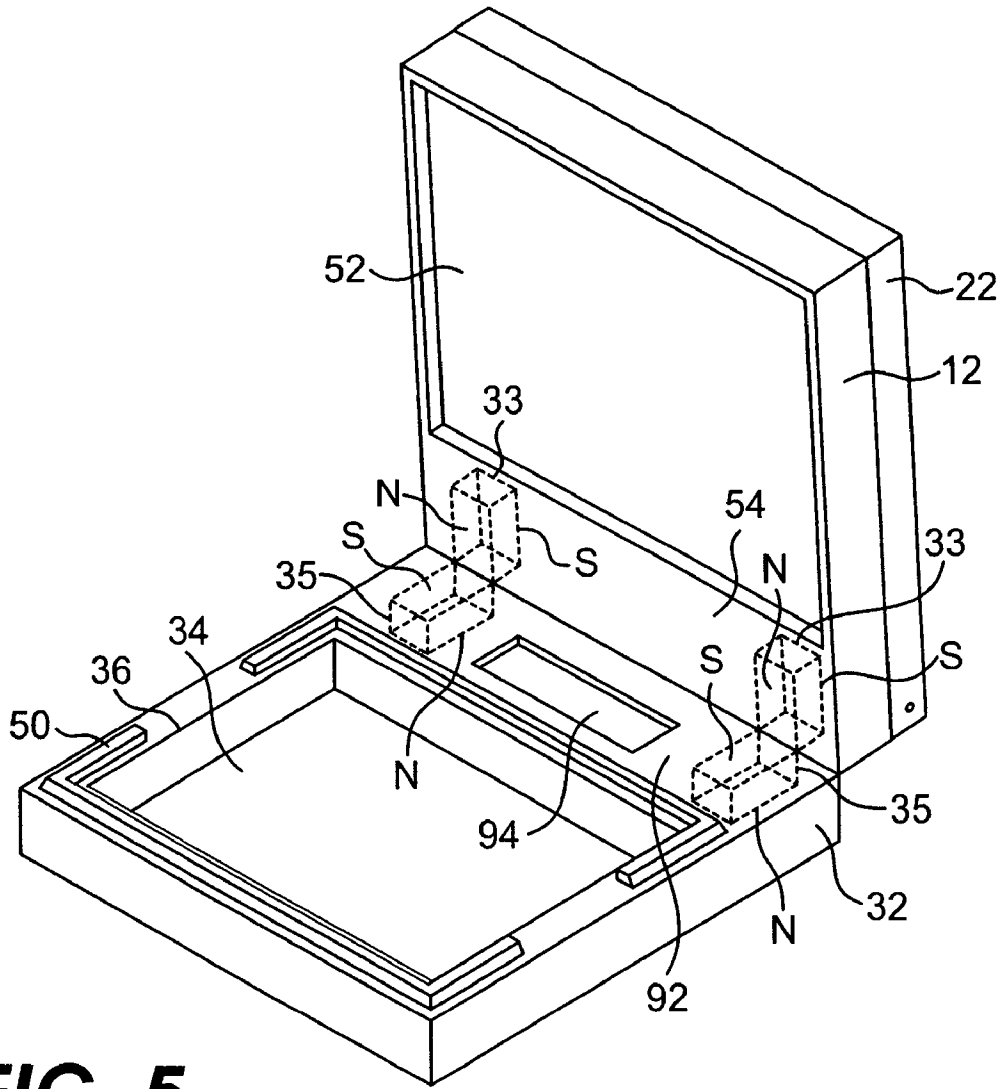
FIG. 5 is a schematic perspective view of the container system embodiment of FIG. 1, wherein one base is moved with respect to the other.

According to some embodiments, the base 12 may be hingedly associated with the second base 32, e.g., as depicted in FIG. 5. For example, the base 12 and second base 32 may be hingedly associated with one another via any hinge-like structure, such as, e.g., a magnetic hinge-like such as that described in U.S. Patent Publication No. 2002/01532276, which is incorporated herein by reference to the extent that it is not inconsistent with the subject matter described herein. For example, as shown in FIG. 5 the device 10 may include one or more magnets 33 associated with the base 12 and one or more magnets 35 associated with the second base 32. To be more specific, the device 10 may include a pair of the magnets 33 integrated into the base 12 and a pair of magnets 35 integrated into the second base 32. The magnets 33 and 35 may be arranged to create a magnetic coupling of the base 12 and the second base 32 when the base 12 and the second base 32 are stacked one on the other.

Figure 4:
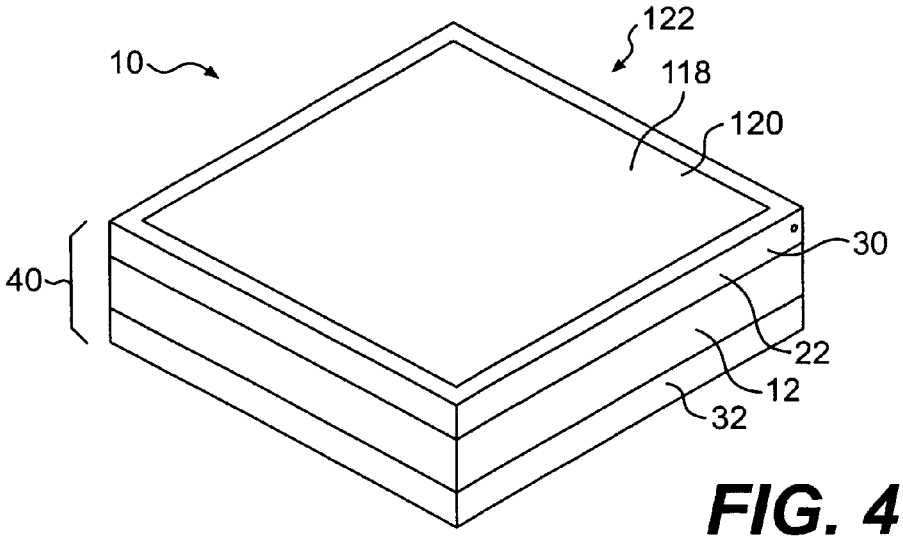
FIG. 4 is a schematic perspective view of the container system embodiment of FIG. 1, wherein the cover is in a closed position.

In addition to magnetically coupling the base 12 and the second base 32 when one is stacked on the other, the magnets may also magnetically couple the base 12 and second base 32 during movement of the base 12 with respect to the second base 32, in a generally hinge-like manner, between a closed position, e.g., as shown in FIG. 4, and an open position, e.g., as shown in FIG. 5. In addition, the magnets 33 and 35 may be arranged to maintain the base 12 in its closed position, for example, as shown in FIG. 4, until a sufficient opening force is applied by a user.

As shown in FIG. 5, each of the magnets 33 and 35 may have a generally parallelepiped shape and the longest dimension of each of the magnets 33 and 35 may be positioned in a direction generally perpendicular to the axis about which the generally hinge-like movement of the base 12 takes place. One of the pair of magnets 33 in the base 12 is magnetically coupled to a respective one of the pair of magnets 35 in the second base 32 and the other of the magnets 33 is magnetically coupled to the other of the magnets 35. In each of the coupled sets of magnets 33 and 35, the poles of the magnets 33 and 35 generally face in opposite directions. In the exemplary embodiment of FIG. 5, the South poles (S) of the base magnets 33 face in a direction generally opposite to that of the North poles (N) of the second base magnets 35, and the North poles (N) of the base magnets 33 face toward the South poles (S) of the second base magnets 35 (or vice versa (not shown)).

When the base 12 is in its closed position (see, e.g., FIG. 4) base magnets 33 may be generally parallel with the second base magnets 35 and, in each coupled magnet set, the magnets 33 and 35 may overlap the other. During the opening movement of the base 12, the base magnets 33 may be magnetically coupled to the second base magnets 35 at all times from the closed position to the open position. When the base 12 is in the open position, the magnets 33 and 35 may be arranged to apply magnetic forces that stabilize the base 12 with respect to the second base 32.

Figure 6:
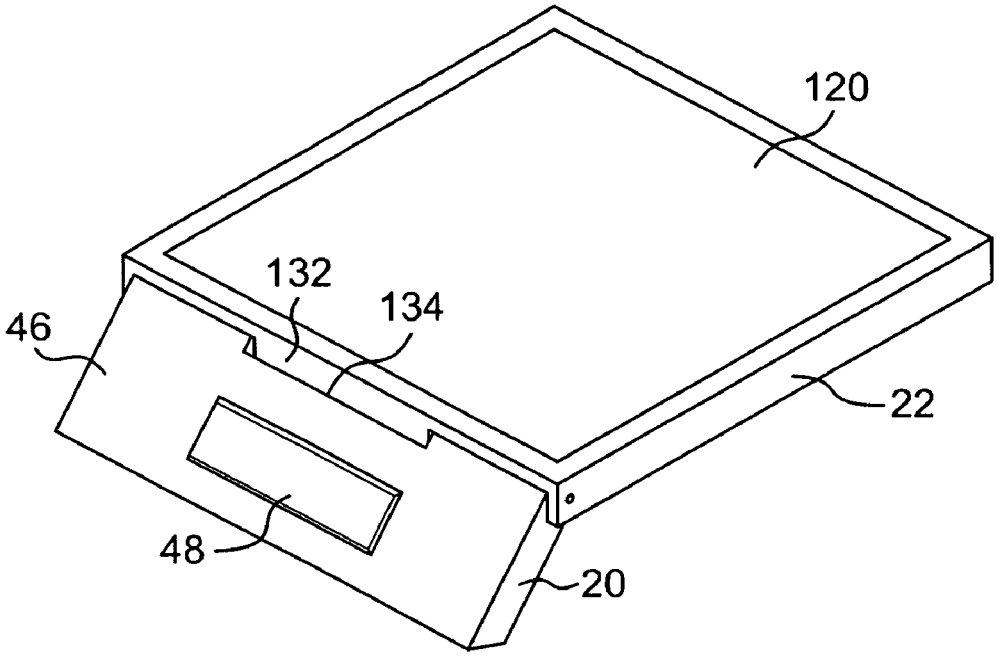
FIG. 6 is schematic perspective view of one example of a device for the system embodiment of FIG. 1.
Figure 7:
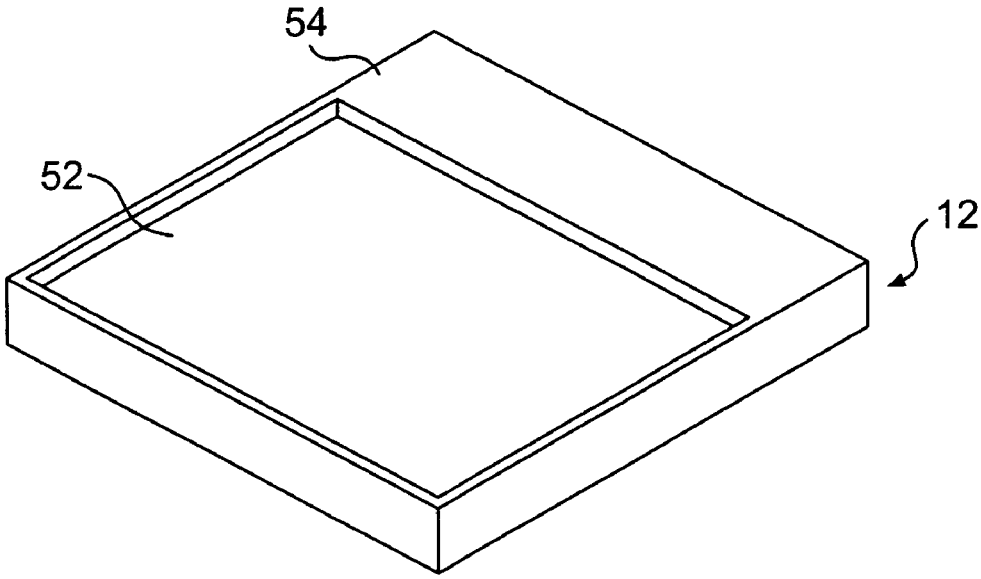
FIG. 7 is a schematic, perspective underside view of an exemplary base for the system embodiment of FIG. 1.

As depicted in FIG. 4, the device 18 and the base 12 (or bases 12 and 32) may be configured such that when removably connected to one another, they are registered with respect to one another so that they form a generally aligned stack 40. As shown in FIG. 1, the base 12 may include a connecting portion 42 configured to be associated with the tab 20. The connecting portion 42 may include a recess 44 configured to mate with a complimentary connecting portion 46, such as a protrusion 48 (see, e.g., FIG. 6) on the tab 20, so that the cover 22 associated with the tab 20 may be substantially registered on the base 12. Other arrangements are possible. For example, a recess may be provided on the connecting portion of the tab and the protrusion may be located on the connecting portion of the base. Furthermore, the base 12 (or bases) may include a registration element, such as for example, a peripheral rim 50, which may be located adjacent the opening 16 of the receptacle 14. The base 12 may also include a recess 52 (see, e.g., FIG. 7) located on a bottom side 54 that is configured to mate with the peripheral rim 50 of the second base 32 below the base 12. The cover 22 of the device 18 may also define a surface 56 that is configured to mate with the peripheral rim 50 of the base 12, so that the cover 22, the base 12, and any additional bases are in substantial alignment with one another when assembled into a stack 40, for example, as shown in FIG. 4.

Figure 8:
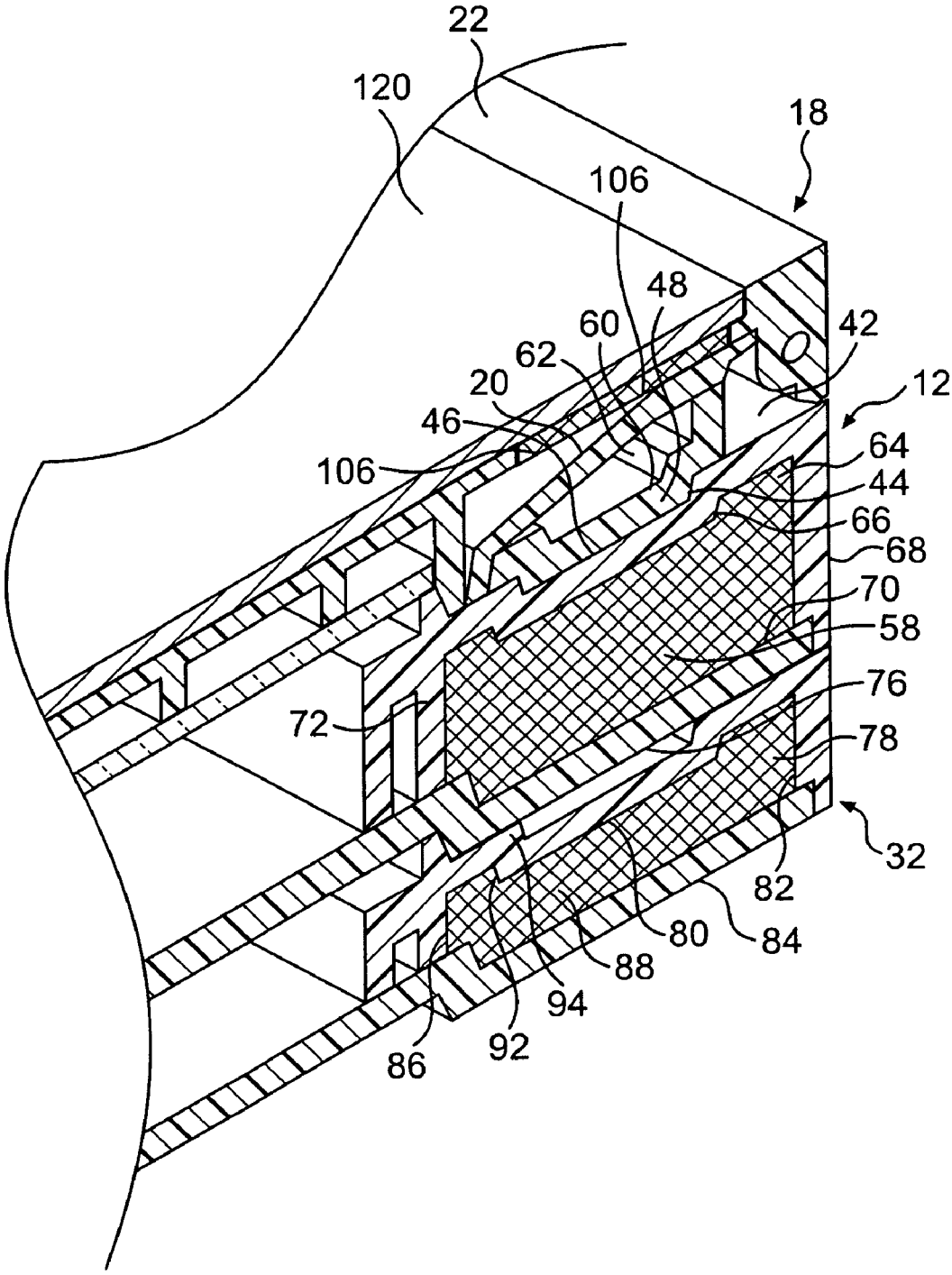
FIG. 8 is a partial, schematic section view of the container system embodiment of FIG. 1.

According some embodiments, the base 12 and the tab 20 may be removably connected to one another via, for example, magnetic attraction. For example, as shown in FIG. 8, the base 12 may include at least one magnetic element 58 in the vicinity of the connecting portion 42, and the tab 20 may include either a magnetic element 60 or an element (e.g., a metal plate) configured to be attracted to the magnetic element 58 in the base 12. Alternatively, the tab 20 may include a magnetic element, and the base 12 may include an element configured to be attracted to the magnetic element in the connecting portion 46 of the tab 20.

In the exemplary embodiment depicted in FIG. 8, the connecting portion 46 of the tab 20 defines a depression 62 for receiving one or more magnets 60. The magnet(s) 60 may include the protrusion 48 (or the recess, as mentioned above), so that the connecting portion 46 of the tab 20 and the connecting portion 42 of the base 12 become substantially aligned with one another when removably connected to one another.

According to the exemplary embodiment depicted in FIG. 8, for example, the base 12 includes a housing 64 being defined by relatively thin walls 66, 68, 70, and 72, and containing the magnet(s) 58. As shown in FIG. 8, the connecting portion 46 of the tab 20 abuts the base connecting portion 42 and does not extend into the housing 64 of the base 12. The wall 66 may include the recess 44 (or a protrusion) configured to mate with the corresponding protrusion 48 (or recess) defined by the connecting portion 46 of the tab 20. The wall 70 located on the underside of the base 12 may include a protrusion 76 (or a recess) configured to align the base 12 with a cooperating recess (or protrusion) of the second base 32. For example, the second base 32 may include a housing 78 being defined by relatively thin walls 80, 82, 84, and 86, and containing one or more magnets 88. The wall 80 located on an upper surface of a connecting portion 92 may include a recess 94 (or a protrusion) configured to mate with the corresponding protrusion 76 (or recess) defined by the connecting portion 46 of the tab 20 and/or the connecting portion 42 of the base 12. Configured in this exemplary manner, the base 12 and the second base 32 are interchangeable. For example, the device 18 may be mounted on the second base 32 rather than on the base 12, and the second base 32 may be mounted on the base 12. Of course additional interchangeable bases (not shown) may be mounted onto one another to expand the system to include more bases that may contain additional and/or alternative cosmetic products and/or cosmetic product applicators.

Figure 9A:
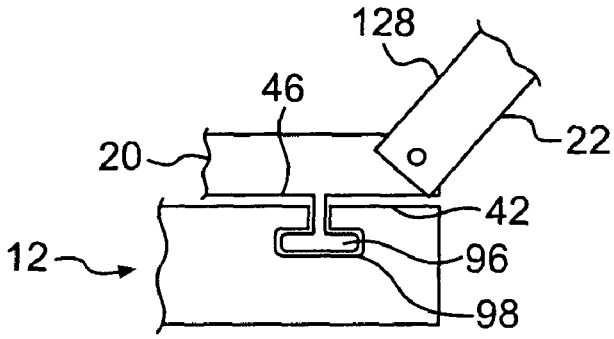
FIG. 9A is a partial, schematic section view of another alternative embodiment of a container system.
Figure 9B:
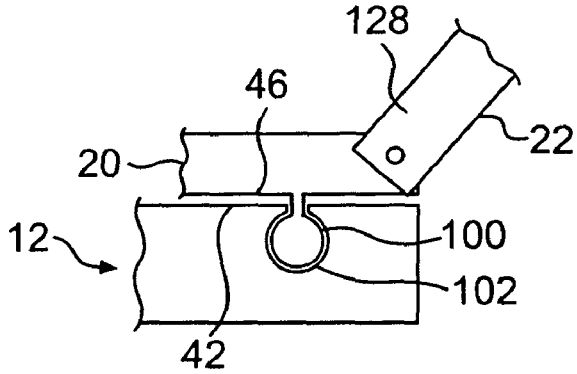
FIG. 9B is a partial, schematic section view of another alternative embodiment of a container system.
Figure 9C:
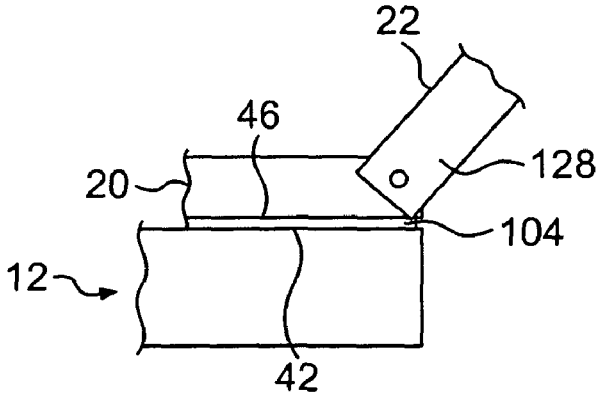
FIG. 9C is a partial, schematic section view of a further alternative embodiment of a container system.

The tab 20 and the base 12 may be removably connected to one another in alternative ways. For example, as shown in FIG. 9A, the connecting portion 46 of the tab 20 may include a T-shaped profile 96 configured to engage a corresponding T-shaped slot 98 in the connecting portion 42 of the base 12. Profiles and slots having alternative shapes may also be used. For example, FIG. 9B shows a circular-shaped profile 100 and a circular-shaped slot 102. The profile and slot may be reversed such that the slot is defined by the connecting portion 46 of the tab 20 and the profile is defined by the connecting portion 42 of the base 12. According to some embodiments, the tab 20 and the base 12 may be removably connected to one another via a reusable adhesive layer 104 and/or via a hook and loop fastener system (e.g., as schematically depicted by layer 104 in FIG. 9C). Alternatively (or additionally), other arrangements may be used to removably connect the tab 20 and one or more bases to one another.

Figure 10:
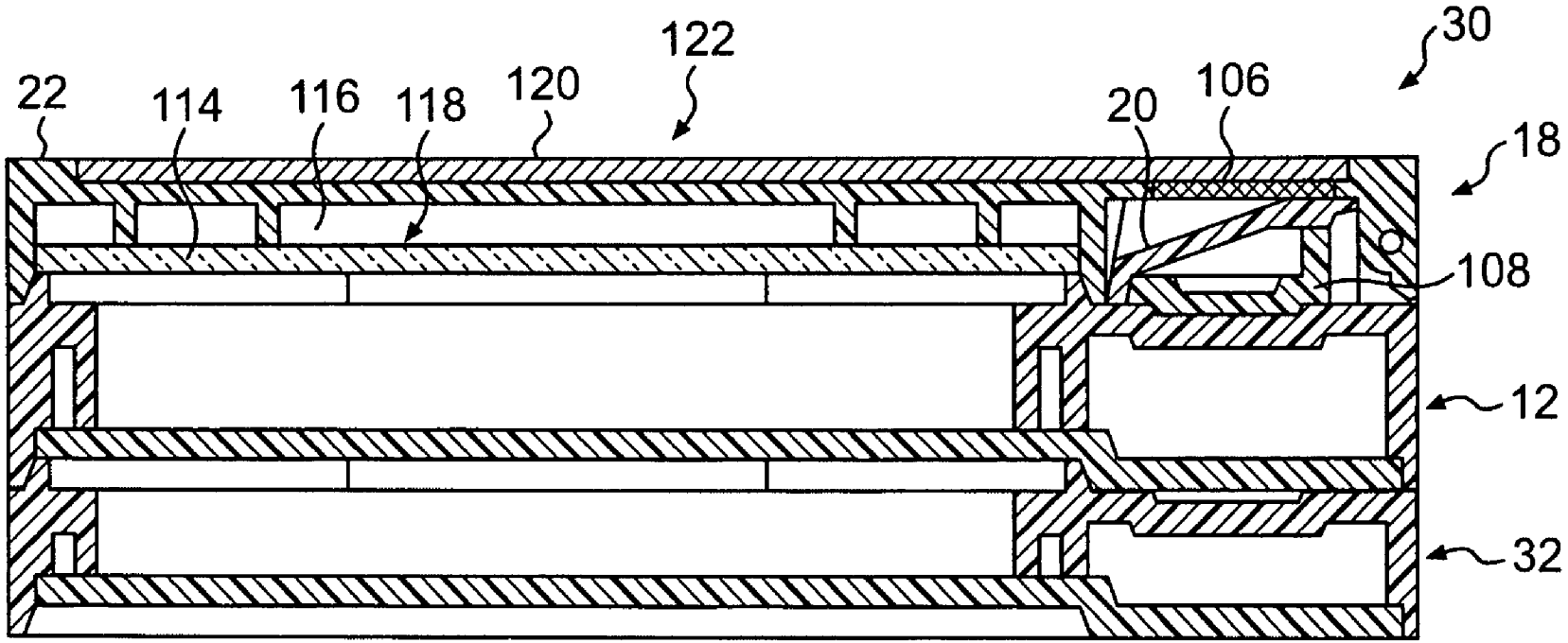
FIG. 10 is a schematic section view of the container system embodiment of FIG. 1, wherein the cover is in the closed position of FIG. 4.
Figure 11:
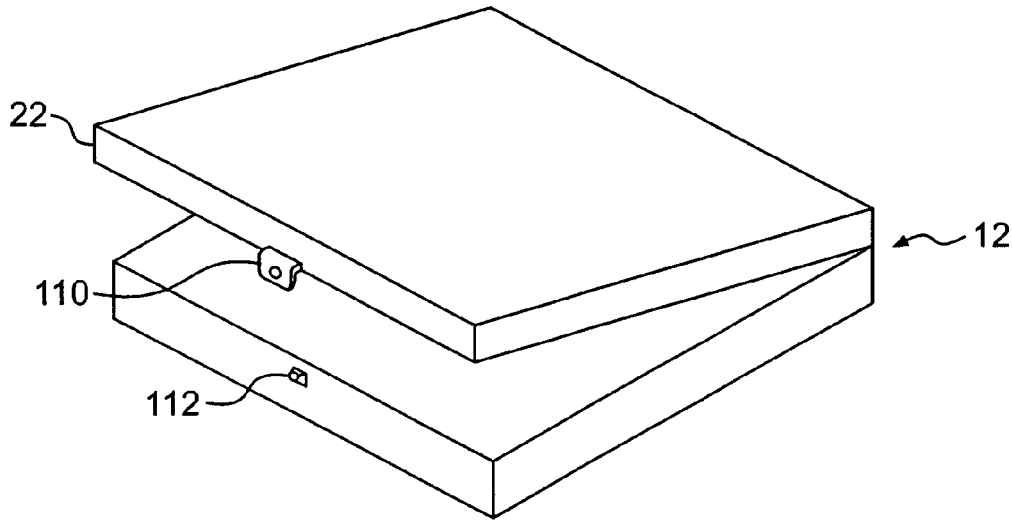
FIG. 11 is schematic perspective view of another alternative embodiment of a container system.

According to the exemplary embodiment depicted in FIG. 10, the cover 22 and tab 20 may be configured such that when the device 18 is positioned on the base 12, the cover 22 and the tab 20 form a latch mechanism that tends to keep the cover 22 in a closed position 30 over the opening 16 in the base 12. For example, the cover 22 may include a latch element 106 that may include either a magnetic element or an element (e.g., a metallic plate) configured to be attracted to a magnetic element. With such an exemplary configuration, when the cover 22 is in a closed position 30 on the base 12, the latch element 106 on the cover 22 is magnetically attracted to the magnetic element 108 of the tab 20. Alternatively, or in addition, as shown in FIG. 11, the cover 22 may include a catch 110 and the base 12 may include a cooperating catch 112, for example, that tends to keep the cover 22 in a closed position 30 on the base 12 until the user intends to open the cover 22.

According to some exemplary embodiments, the cover 22 may include a mirror 114, as shown in FIGS. 1 and 10, provided in a recess 116 located on an interior side 118 of the cover 22, for example, to allow the user to view themselves while applying a cosmetic product and/or using an applicator stored in the container system 10. In some embodiments, the cover 22 may include a removable panel 120 located on an exterior 122 of the cover 22, for example, as shown in FIGS. 4, 8, and 10, so that various removable panels 120 (e.g., decorative panels) may be substituted in place of one another based on, for example, the user's desired decorative effect (e.g., to match the user's clothing and/or accessories).

Figure 12:
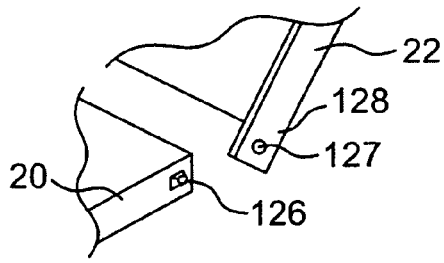
FIG. 12 is a partial, schematic perspective view of another alternative embodiment of a container system.
Figure 13:
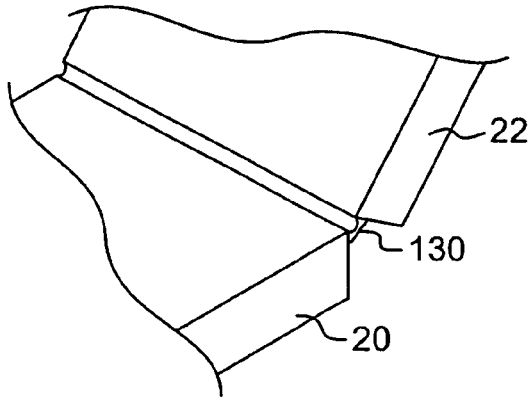
FIG. 13 is a partial, schematic perspective view of a further alternative embodiment of a container system.
Figure 14:
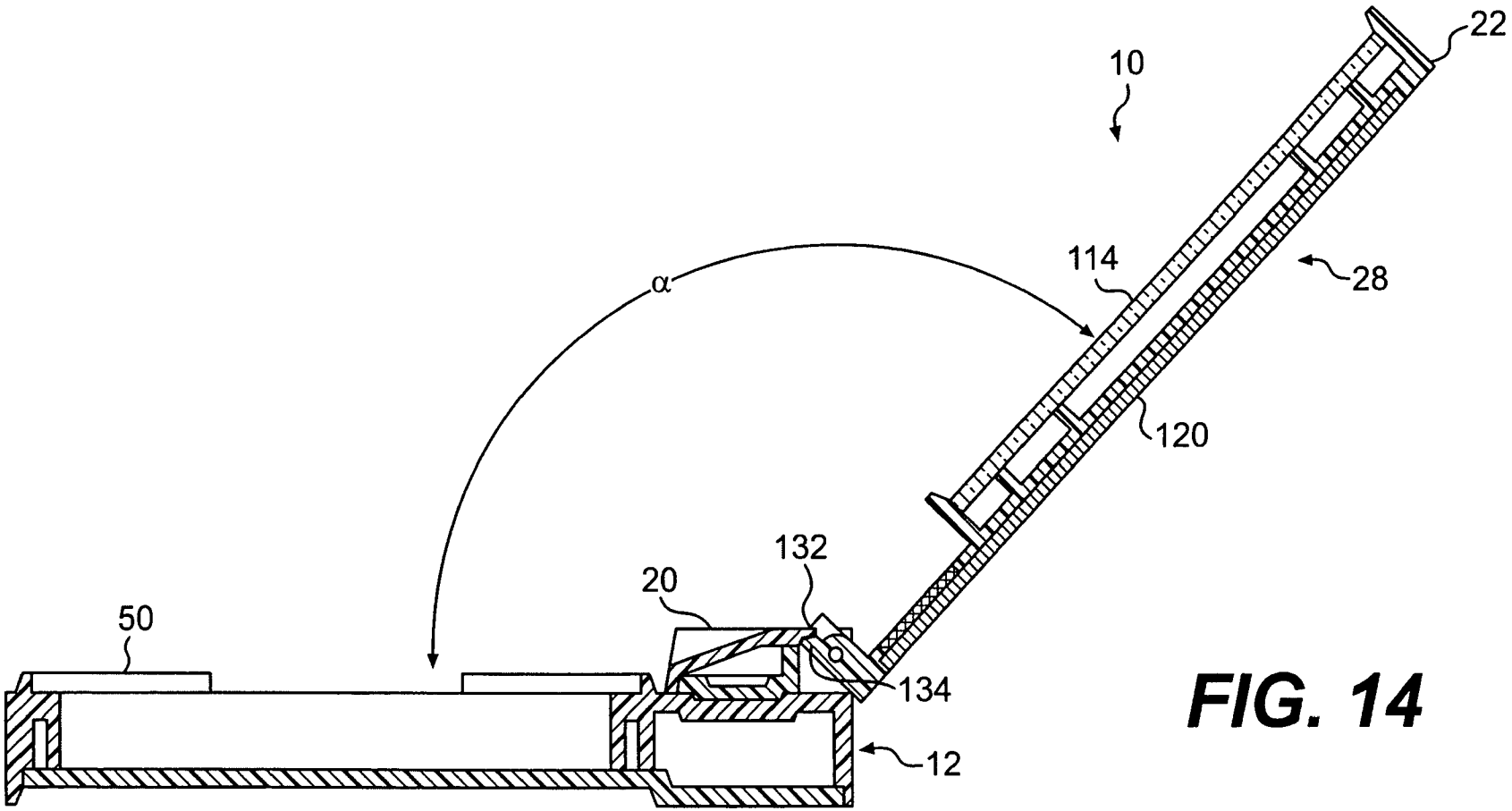
FIG. 14 is a partial, schematic elevation section view of the embodiment of FIG. 1, wherein the cover is in the open position of FIG. 3.

The cover 22 and the tab 20 may be hingedly associated with one another in various ways. For example, in the exemplary embodiment depicted in FIG. 1, the cover 22 may be hingedly associated with the tab 20 via one or more pins 122, which protrude from the tab 20 into apertures 124 located in rearward extensions 128 of the cover 22. Alternatively, for example, as shown in FIG. 12, the tab 20 may include protrusions 126, which extend into apertures 127 located in rearward extensions 128 of the cover 22. Referring to FIG. 13, in some exemplary embodiments, the cover 22 and the tab 20 may be hingedly associated with one another via, for example, a flexible member 130.

According some embodiments, such as the exemplary embodiment depicted in FIG. 12, the cover 22 and the tab 20 may be configured to limit an extent of the hinge-like movement of the cover 22 with respect to the tab 20 so that when the cover 22 is moved from a closed position 30 to an open position 28, the cover 22 moves with respect to the base 12 up to a maximum angular extent a of less than about 180 degrees. The tab 20 may include a projection 132 for abutting against a bearing surface 134 of the cover 22 to limit the extent of the opening angle $\alpha$. The limited opening angle $\alpha$ of the cover 22 with respect to the base 12 may position the mirror 114 (i.e., in systems including a mirror) at a particular angle, possibly assisting a user in viewing herself in the mirror 114 during use of the system 10 (e.g., during application of a cosmetic product when the base 12 is resting on a somewhat flat and level surface or resting in the user's hand). The angle $\alpha$ may be less than about 180 degrees (e.g., less than or equal to about 160 degrees) and greater than or equal to about 100 degrees. For example, the angle $\alpha$ may be about 130 degrees.

Figure 3:
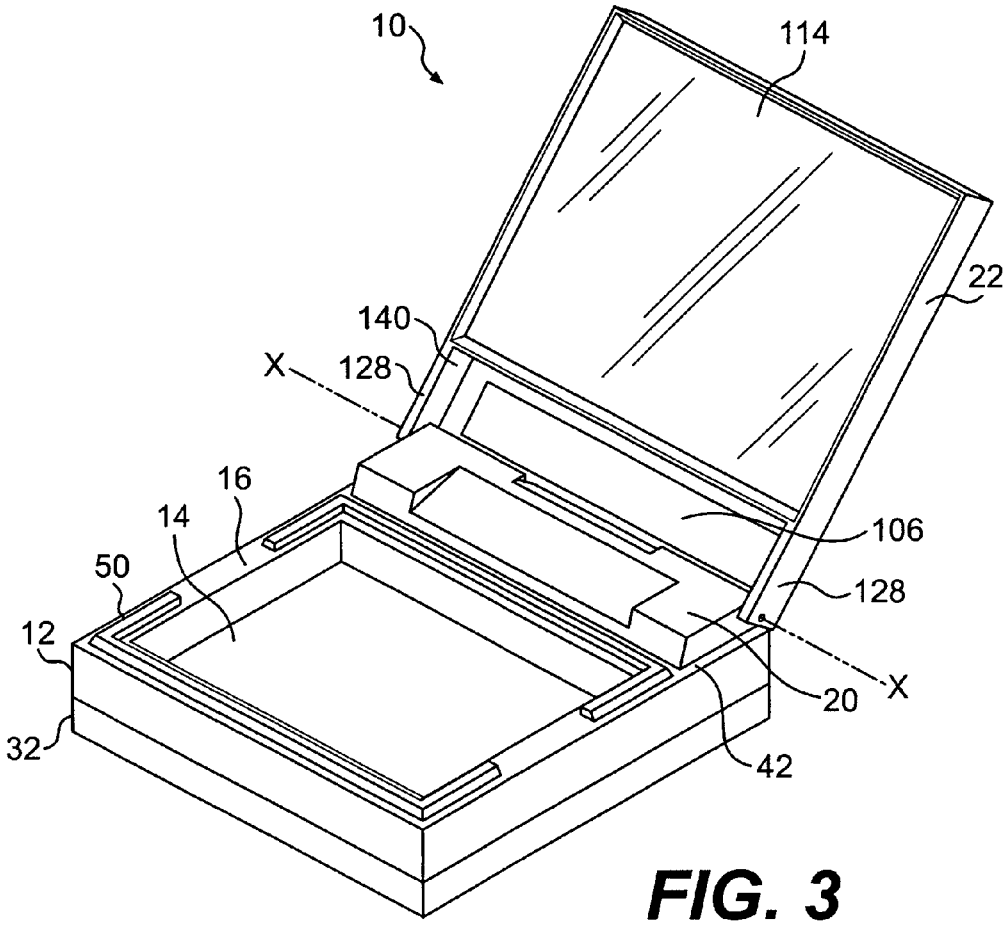
FIG. 3 is a schematic perspective view of the container system embodiment of FIG. 1, wherein a cover is in an open position.

According to the exemplary embodiment depicted in FIGS. 3 and 4, the cover 22 and the tab 20 may be configured such that the tab 20 is not generally visible when the container system 10 is viewed in a direction parallel to the hinging axis X about which the cover 22 and tab 20 move with respect to one another. Such an arrangement may sometimes provide a more pleasing appearance. According to some embodiments, the cover 22 defines a recess 140 between rearward extensions 128 and a portion of the cover 22. The tab 20 is received in the recess 140 when the cover 22 is moved in a hinge-like fashion with respect to the tab 20 to the closed position 30, as shown in FIG. 4.

It will be apparent to those skilled in the art that various modifications and variations can be made to the structure described herein. Thus, it should be understood that the invention is not limited to the subject matter discussed in the specification. Rather, the present invention is intended to cover modifications and variations.

What is claimed is:

1. A container system for at least one of a cosmetic product and a cosmetic product applicator, the system comprising:
- a base comprising a receptacle having an opening,
- wherein the receptacle is configured to contain the at least one of a cosmetic product and an applicator for applying a cosmetic product; and
- a device comprising
  - a cover configured to close the opening, and
  - a tab hingedly associated with the cover such that a hinging axis is defined, the tab comprising a connecting portion configured to removably connect the tab to the base,
- wherein the connecting portion of the tab does not move relative to the base as the cover moves between an open position and a closed position,
- wherein the cover defines a recess such that when the tab is connected to the base and the cover closes the opening, the tab is housed in the recess and is not visible when the container system is viewed in a direction parallel to the hinging axis, and
- wherein the base defines a base connecting portion and a housing, and
- wherein the connecting portion of the tab abuts the base connecting portion and does not extend into the housing of the base.

2. The system of claim 1, wherein the receptacle contains a cosmetic product.

3. The system of claim 1, wherein the receptacle contains a cosmetic product applicator.

4. The system of claim 1, wherein the base and the tab are removably connected to each other via magnetic attraction.

5. The system of claim 4, wherein at least one of the tab and the base comprises at least one magnetic element.

6. The system of claim 1, wherein the connecting portion comprises a reusable adhesive layer configured to removably connect the tab and the base to one another.

7. The system of claim 1, wherein the connecting portion comprises at least one of a hook portion and a loop portion of a hook and loop fastener system, and the base comprises the other of the hook portion and the loop portion, and wherein the hook and loop fastener system is configured to removably connect the tab and the base to one another.

8. The system of claim 1, wherein the connecting portion comprises one of a protrusion and a recess, and the base comprises the other of the protrusion and the recess, such that the connecting portion and the base are configured to align with one another.

9. The system of claim 1, wherein the cover comprises a mirror.

10. The system of claim 1, further comprising a latching mechanism configured to maintain closure of the cover.

11. The system of claim 10, wherein the latching mechanism comprises a magnetic attraction between the tab and the cover.

12. The system of claim 10, wherein the latching mechanism comprises a latch element provided on the cover, the latch element configured to be attracted to a magnetic element.

13. The system of claim 12, wherein the latch element of the cover comprises a metallic element and wherein the connecting portion comprises at least one magnetic element.

14. The system of claim 1, wherein the tab and cover are hingedly associated via a structure that facilitates movement of the cover with respect to the tab in a pivoting manner.

15. The system of claim 14, wherein the cover comprises a catch located opposite the structure, and the base comprises a cooperating catch configured to engage with the catch of the cover.

16. The system of claim 14, wherein the structure comprises at least one pin and at least one aperture located on at least one of the tab and the cover.

17. The system of claim 14, wherein the structure comprises one of protrusions and recesses provided on the cover and the other of the protrusions and the recesses provided on the tab.

18. The system of claim 14, wherein the structure comprises a flexible member associating the cover with the tab in a pivoting fashion.

19. The system of claim 1, wherein the cover is configured to move in a pivoting manner with respect to the base between a closed position in which the cover covers the opening of the base and an open position in which access to the receptacle is permitted, wherein the device is configured to limit an extent of the pivoting movement of the cover so that when the cover is moved from the closed position to the open position, the cover moves with respect to the base up to a maximum angular extent of less than about 180 degrees.

20. The system of claim 1, further comprising a second base comprising a receptacle having an opening, wherein the second base is configured to be removably associated with the base.

21. The system of claim 20, wherein the base and the second base each comprise at least one magnetic element, the magnetic elements coupling the base and the second base to one another.

22. The system of claim 20, wherein at least one of the base receptacle and the second base receptacle contains at least one of a cosmetic product and a cosmetic product applicator.

23. The container system of claim 1, wherein the connecting portion of the tab does not extend into the housing of the base when the cover closes the opening of the base.

24. A container system for at least one of a cosmetic product and a cosmetic product applicator, the system comprising:

a first base comprising an upper surface and a receptacle having an opening in the upper surface;

a second base comprising a receptacle having an opening;

wherein each of the receptacles is configured to contain the at least one of a cosmetic product and a cosmetic product applicator; and a device comprising a cover configured to close the opening of at least the first base, and a tab hingedly associated with the cover, the tab comprising a connecting portion removably connecting the tab directly to the upper surface of the first base such that the cover is removable from the first base, wherein the connecting portion of the tab does not move relative to the first base as the cover moves between an open position and a closed position, wherein the first base comprises at least one first magnet and the second base comprises at least one second magnet, the first and second magnets coupling the first base and the second base to one another, wherein the base defines a base connecting portion and a housing, and wherein the connecting portion of the tab abuts the base connecting portion and does not extend into the housing of the base.

25. The system of claim 24, wherein at least one of the receptacles contains a cosmetic product.

26. The system of claim 24, wherein at least one of the receptacles contains a cosmetic product applicator.

27. The system of claim 24, wherein the first base and the tab are removably connected to each other via magnetic attraction.

28. The system of claim 27, wherein the tab comprises at least one magnetic element.

29. The system of claim 24, wherein the cover comprises a mirror.

30. The system of claim 24, further comprising a latching mechanism configured to maintain closure of the cover.

31. The system of claim 30, wherein the latching mechanism comprises a magnetic attraction between the tab and the cover.

32. The system of claim 30, wherein the latching mechanism comprises a latch element provided on the cover, the latch element configured to be attracted to a magnetic element.

33. The system of claim 32, wherein the latch element of the cover comprises a metallic element and wherein the connecting portion comprises at least one magnetic element.

34. The system of claim 24, wherein the cover is configured to move in a pivoting manner with respect to the first base between a closed position in which the cover covers the opening of the first base and an open position in which access to the receptacle is permitted, wherein the device is configured to limit an extent of the pivoting movement of the cover so that when the cover is moved from the closed position to the open position, the cover moves with respect to the first base up to a maximum angular extent of less than about 180 degrees.

* * * * *